United States Patent [19]

Itzkoff

[11] Patent Number: 5,032,091

[45] Date of Patent: Jul. 16, 1991

[54] FILTER ADAPTER FOR PANEL MOUNTED COAXIAL CONNECTORS

[75] Inventor: Jack Itzkoff, Yorktown Hts., N.Y.

[73] Assignee: Kings Electronics Co., Inc., Tuckahoe, N.Y.

[21] Appl. No.: 566,514

[22] Filed: Aug. 10, 1990

[51] Int. Cl.[5] ..... H01R 13/66

[52] U.S. Cl. ..... 439/620; 333/182

[58] Field of Search ..... 439/620, 544–550, 439/577–585, 533, 551, 562, 567, 569, 508; 333/181–184, 206

[56] References Cited

U.S. PATENT DOCUMENTS

| | | | |
|---|---|---|---|
| 613,647 | 11/1898 | Brown | 439/551 |
| 4,229,714 | 10/1980 | Yu | 333/182 X |
| 4,268,105 | 5/1981 | Widmayer et al. | 439/620 X |
| 4,772,221 | 9/1988 | Kozlof | 439/620 X |
| 4,797,120 | 1/1989 | Ulery | 439/620 X |
| 4,929,196 | 5/1990 | Ponn et al. | 439/620 |
| 4,934,960 | 6/1990 | Capp et al. | 439/620 |

*Primary Examiner*—Larry I. Schwartz
*Assistant Examiner*—Julie R. Daulton
*Attorney, Agent, or Firm*—Jordan B. Bierman

[57] ABSTRACT

An adapter including an insulating, three shouldered adapter having a filter device disposed in a channel formed therein. When inserted between a RF-type cable connector and a panel mounted receiving connector, the adapter effectively isolates the shell of the connector from the panel and insures that all ground currents must pass through the filtering device. The configuration of the shoulders allows the adapter to be used with all standard cable connectors designed for panel mounting.

4 Claims, 1 Drawing Sheet

FILTER ADAPTER FOR PANEL MOUNTED COAXIAL CONNECTORS

The present invention is directed to an electrical adapter and more specifically, to an adapter which allows a filter to be inserted between any standard radio frequency (RF)-type cable panel connector and the chassis to which it is mounted so that all ground currents pass through the filter.

BACKGROUND OF THE INVENTION

A typical RF-type cable, including coaxial, twin-axial, and triaxial cables, comprises at least one inner conductive wire, a surrounding conductor (braid), a dielectric insulating layer disposed between the conductor and the braid, and an outer insulating jacket. Such cables are usually connected to devices using connector assemblies crimped or soldered onto the cable end. The RF connector is screwed onto a metal panel and is mated to a receiving connector. The above arrangement was found to be disadvantageous, however, as electrical noise could be passed directly into the connector shell from the metal panel.

BRIEF DESCRIPTION OF THE INVENTION

In view of the above, it is an object of the present invention to provide a filter adapter which is inserted between the cable/connector assembly and the mounting chassis of the device to which it is attached and provides for the mounting of a suitable filtering device therebetween. The inventive device is simple, inexpensive and, due to its unique configuration, allows use with any common cable connector assembly. Other objects and features of the present invention will become apparent from the following detailed description considered in conjunction with the accompanying drawings.

DETAILED DESCRIPTION OF THE INVENTION

Figure 1:
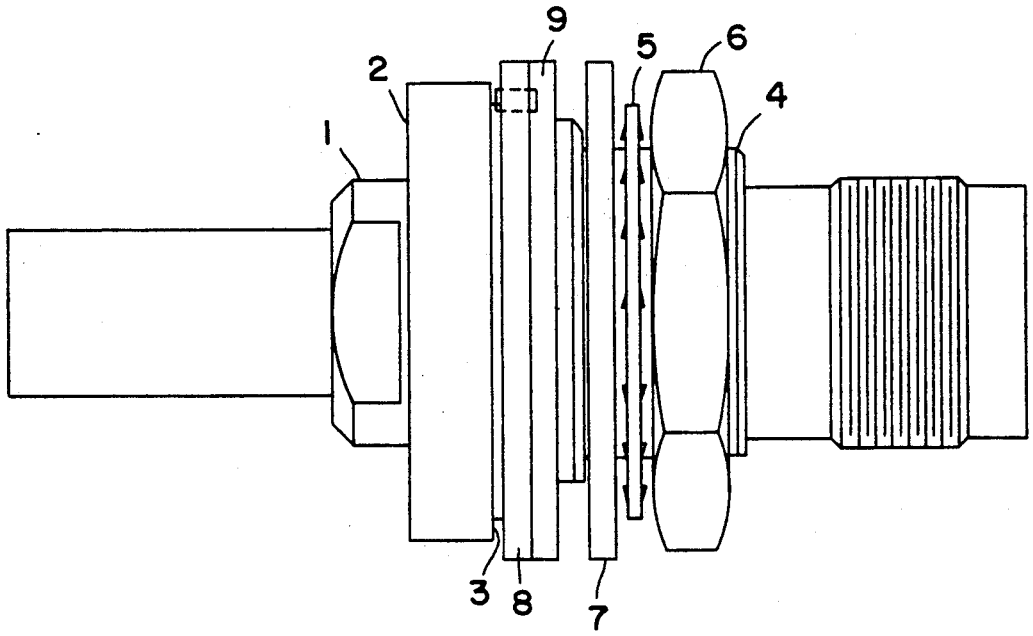
FIG. 1 is a side view of a standard prior art connector assembly with the inventive adapter mounted thereon.

Referring to FIG. 1, there is shown an inventive adapter installed on a prior art RF cable connector. The connector comprises metal outer body 1 formed with body flange 2, which rests against the chassis of the external device (not shown) to which the connector is to be connected. Body flange 2, in ordinary connectors, is further supplied with annular ring 3 provided with an O-ring which is pressed between flange 2 and the chassis. Within flange 2 there is supplied threaded section 4 having a flattened portion that fits into a prepared hole in the mounting panel of the chassis. When installed, the connector is held in place by lock washer 5 and nut 6.

Figure 2:
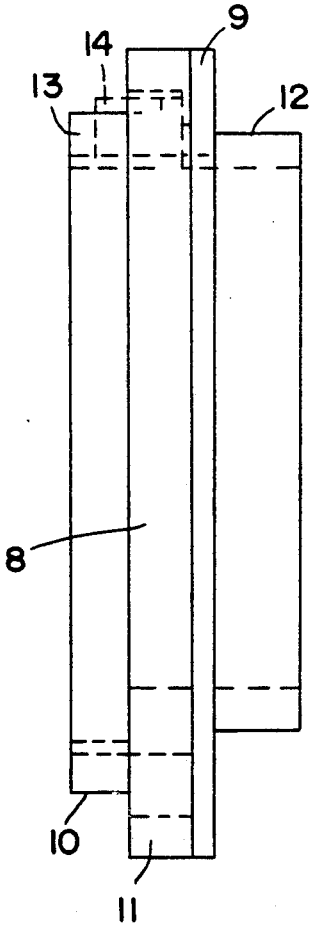
FIG. 2 is a side view of the inventive adapter.

The inventive adapter (shown in detail in FIG. 2) replaces the O-ring, as described above, and includes insulating gasket 8, backed by metal ring 9. The insulating gasket is provided with 3 shoulders of differing diameter; outer shoulder 10 which fits into annular ring

3 on connector body 1, middle shoulder 11 having a diameter approximating that of flange 2 and being positioned between flange 2 and the chassis and, inner shoulder 12 onto which metal ring 9 is forced. Inner shoulder 12 extends, at least partially, into the mounting hole of the panel.

Gasket 8 is formed with slot 13, into which filtering device 14, such as a capacitor, is inserted. Gasket 8 effectively isolates connector body 1 from the panel and insures that all ground currents pass through filtering device 14. The unique shoulder configuration of the gasket insures that any standard bulkhead mounted connector can be adapted to include a filtering unit. To further insure isolation, insulating ring 7 can be fitted over threaded portion 4 of connector body 1 where it protrudes through the back end of the panel. The filter assembly does not, in any manner interfere with the direct connection of the center conductor of the cable.

Of course, although the invention has been described in conjunction with RF-type cables, clearly, the inventive filter assembly could be easily adapted to, for example, reduce the effects of EMI in such applications as computers. Further, while only the fundamental novel features of the invention as applied to a preferred embodiment thereof have been shown and described, it is understood that various omissions, substitutions, and changes in the form and details of the device illustrated and in its operation, may be made by those skilled in the art without departing from the spirit of the invention. It is therefore the intention of Applicant that the invention be limited only as indicated by the scope of the claims appended hereto.

I claim:

1. An adaptor for filtering signals between an electrical connector and a panel mounted receiving connector of an external device, said adaptor comprising an insulating gasket for isolating said electrical connector from said receiving connector, said insulating gasket being provided with a non-insulated gap therethrough and a filtering means disposed in said gap contacting both said electrical connector and said receiving connector, all ground currents between said electrical connector and said receiving panel being passed solely through said filter means, said gasket comprising at least three shoulders of differing diameters, an outer shoulder adapted to fit into an annular ring formed in said electrical connector, a middle shoulder having a diameter at least as great as that of said electrical connector and being adapted to be maintained in a position between said electrical connector and the panel, and an inner ring adapted to extend through a mounting hole provided in said panel.

2. The adapter of claim 1 wherein said filtering means is a capacitor.

3. The adapter of claim 1 further comprising an insulating ring adapted to fit between a washer used to secure said electrical connector on a back of the panel and said panel.

4. The adapter of claim 1 further comprising a backing ring pressfitted onto an outside diameter of said inner shoulder.

* * * * *